United States Patent [19]

Ishida et al.

[11] 4,238,562

[45] Dec. 9, 1980

[54] LIGHT TRANSMISSION PARTICLE FOR FORMING COLOR IMAGE

[75] Inventors: Eisuke Ishida, Nara; Yuji Takashima, Osaka; Hisanori Nishiguchi, Neyagawa; Yoshihide Miyazawa, Tokyo; Shigeru Endo, Machida, all of Japan

[73] Assignees: Hodogaya Chemical Co., Ltd., Tokyo; Matsushita Electric Industrial Co., Ltd., Osaka, both of Japan

[21] Appl. No.: 928,420

[22] Filed: Jul. 27, 1978

[30] Foreign Application Priority Data

Aug. 4, 1977 [JP] Japan ..... 52/93822

[51] Int. Cl.[3] ..... G03G 9/08

[52] U.S. Cl. ..... 430/106; 430/126; 430/45; 430/345; 428/407; 8/2.5 A; 260/326.11 S

[58] Field of Search ..... 252/62.1 R, 62.1 P, 252/62.1 L; 8/2.5 A; 260/326.11 S; 96/90 PC; 428/407; 430/106

[56] References Cited

U.S. PATENT DOCUMENTS

| | | | |
|---|---|---|---|
| 2,940,847 | 6/1960 | Kaprelian | 96/1 |
| 3,080,318 | 3/1963 | Claus | 252/62.1 |
| 3,732,119 | 5/1973 | Churchill | 96/90 PC X |
| 4,121,932 | 10/1978 | Ishida | 252/62.1 P X |
| 4,145,300 | 3/1979 | Hendriks | 252/62.1 P |

FOREIGN PATENT DOCUMENTS

| | | | |
|---|---|---|---|
| 51-82623 | 1/1975 | Japan | 252/62.1 P |
| 987767 | 3/1965 | United Kingdom | 252/62.1 P |

OTHER PUBLICATIONS

Kobayashi et al., "The Photochromism of Evaporated Photospiran", Bull. Chem. Soc. Japan, 1969, 42(9) 2735–2736.

Day, "Thermochromism", Chem. Rev., vol. 63, 1963, pp. 65–66.

*Primary Examiner*—Roland E. Martin, Jr.

*Attorney, Agent, or Firm*—Miller & Prestia

[57] ABSTRACT

Disclosed is a light transmission particle containing a colorless sublimable dye that is a spirobenzopyrane indole compound suitable for use in the formation of a color image. This particle can produce a clear color image having little fogging and having an excellent resolving power.

13 Claims, 13 Drawing Figures

LIGHT TRANSMISSION PARTICLE FOR FORMING COLOR IMAGE

The present invention relates to a light transmission particle or particles suitable for use in the formation of a color image which utilizes optical and chemical properties of such particles and also utilizes electrostatic properties of a sensitized plate. More specifically, it relates to a light transmission particle or particles for forming a color image, which particle contains a colorless sublimable dye or dyes and produces a magenta color.

A typical known method for forming an image by using particles is a so-called electro print marking process in which particles comprising a photoconductive substance are used. According to this known process, the particles are placed on the surface of a conductive base plate which is grounded and, then, the particles are imagewise exposed. Thus, the particles having weakened or removed electrostatic attracting force between the particles and the surface of the base plate by the imagewise exposure are removed from the surface of the base plate to obtain a desired image formed by the remaining particles on the base sheet.

In order to obtain a good image having no fogging according to the above-mentioned method, the electric charge of the particles subjected to the light radiation or irradiation must become approximately zero. For this reason, it is important that the particles and the base plate are brought into an ohmic contact with each other and that the particles have light transmission properties. However, in the case where particles in the form of spheres are placed on the surface of the base plate as in the conventional methods, there are disadvantages in that, in view of the structure of the particles, not only is it impossible to obtain a complete ohmic contact of the particles with the base plate but also electric charges are left in the lower portions of the particles so that much fogging appears in the image. As typical photoconductive substances such as selenium, zinc oxide, cadmium sulfide and the like which are employed in the conventional methods are opaque, they are not preferable for a practical use. Further, in the case where a color image is formed by using the above-mentioned conventional particles and methods, it is necessary to subject the particles (i.e. photoconductive substances) to spectral sensitization. However, there are no suitable sensitizers which can be spectral-sensitized with respect to only blue, green or red. Furthermore, the color development of each respective complementary color has been difficult.

The objects of the present invention are to obviate the above-mentioned disadvantages of the conventional particles and to provide light transmission particles for forming a color image, which are capable of producing a clear color image having little fogging and having an excellent resolving power.

Another object of the present invention is to provide light transmission particles capable of forming a color separated image without the use of a color separation filter.

A further object of the present invention is to provide light transmission particles capable of producing a color image having good color reproduction by only one exposure and one development.

In accordance with the present invention, there is provided a light transmission particle for forming a color image containing at least one spirobenzopyrane indole compound having the general formula [I];

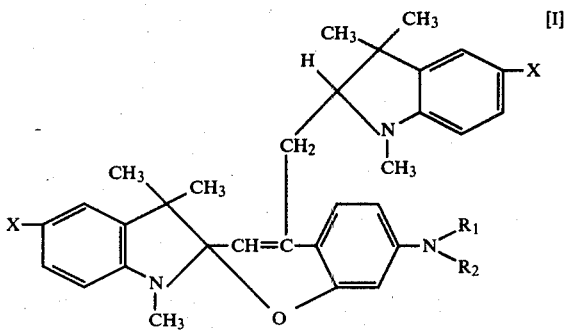

[I]

(wherein $R_1$ and $R_2$ independently represent a methy, ethyl or phenyl group and X represents hydrogen, a methyl group or a halogen atom).

The particle of the present invention comprises, as essential constituents, a colorless sublimable dye or dyes which are capable of developing a magenta color and a carrier through which light can be transmitted. The colorless sublimable dye used in the present invention, which can develop a magenta color is a spirobenzopyrane indole compound having the above-mentioned formula [I]. The spirobenzopyrane indole compound of the present invention can be, for example, 4-(1,3,3-trimethyl-indolino)methyl-7(N,N-diethyl)amino-1',3',3'-trimethyl-spiro[2H-1-benzopyrane-2,2'-[2'H]-indole] having the formula [II] (this is called "compound A" hereinbelow);

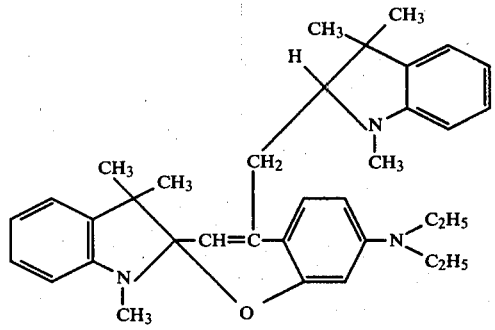

[II]

4-(1,3,3-trimethyl-indolino)methyl-7-(N-methyl-N-phenyl)-amino-1',3',3'-trimethyl-spiro[2H-1-benzopyrane-2,2'-[2'H]-indole] having the formula [III] (this is called "compound B" hereinbelow);

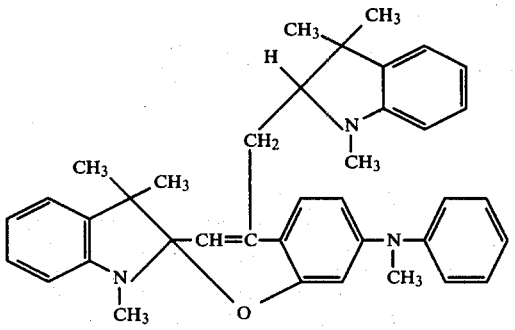

[III]

4-(1,3,3,5-tetramethyl-indolino)methyl-7-(N-methyl-N-phenyl)amino-1',3',3',5'-tetramethyl-spiro[2H-1-benzopyran-2,2'-[2'H]-indole] having the formula [IV] (this is called "compound C" hereinbelow);

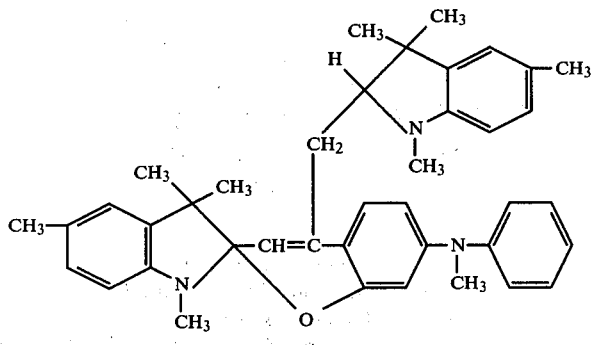

[IV]

4-(5-chloro-1,3,3-trimethyl-indolino)methyl-7-(N-methyl-N-phenyl)amino-5'-chloro-1',3',3'-trimethyl-spiro[2H-1-benzopyran-2,2'-[2'H]-indole] having the following formula [V] (this is called "compound D" hereinbelow), and;

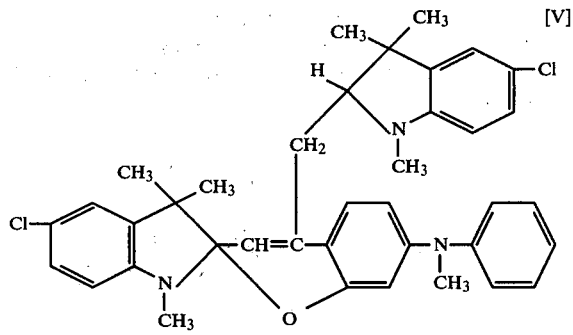

[V]

4-(5-chloro-1,3,3-trimethyl-indolino)methyl-7-(N,N-diethyl)-amino-5'-chloro-1',3',3'-trimethyl-spiro[2H-1-benzopyran-2,2'-[2'H]-indole] having the following formula [VI] (this is called "compound E" hereinbelow).

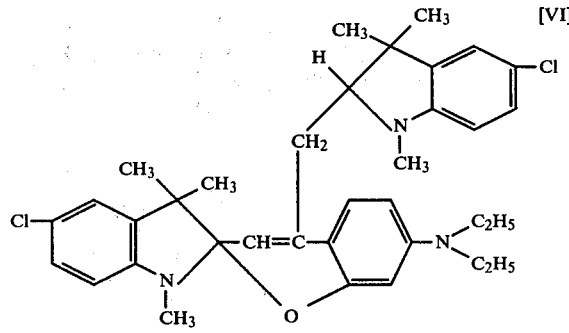

[VI]

The above mentioned compounds can be prepared in the following manner. For example, into a 3000 ml three-necked flask provided with a sealed agitator, a thermometer and a reflux condenser, 1050 ml of ethyl alcohol, 148 g (0.855 mole) of 1,3,3-trimethyl-2-methylene indolenine, 97 g (0.427 mole) of 2-hydroxy-4-(N-methyl-N-phenyl)amino-benzaldehyde and 5 ml of triethylamine are charged. The mixture is reacted for 6 hours by heating and refluxing the mixture. After the completion of the reaction, the reaction mixture is cooled to room temperature to thereby precipitate the crystal. The crystaline product thus precipitated is then filtered. The product is added to 2000 ml of a dilute aqueous sodium hydroxide solution and is stirred for 1 hour at room temperature. Thereafter, the product is filtered off, washed with water and dried and 210 g of a crude crystalline product are produced. The crude crystal is washed with 400 ml of acetone and dried. 196 g of 4-(1,3,3-trimethyl-indolino)methyl-7-(N-methyl-N-phenyl)amino-1',3',3'-trimethyl-spiro[2H-1-benzopyran-2,2'-[2'H]-indole], having pale pink-white color, is obtained. The melting point of this crystal is 169° through 170° C. and the yield is 82.4%.

Another example of the preparation of the above-mentioned compounds is to prepare 4-(5-chloro-1,3,3-trimethyl-indolino)methyl-7-(N-methyl-N-phenyl-)amino-5'-chloro-1',3',3'-trimethyl-spiro[2H-1-benzopyran-2,2'-[2'H]-indole] by reacting 18.6 ml of ethyl alcohol, 6.2 g (0.03 mole) of 5-chloro-1,3,3-trimethyl-2-methylene indolenine, 3.4 g (0.015 mole) of 2-hydroxy-4-(N-methyl-N-phenyl)amino-benzaldehyde and 2 drops of triethylamine in the manner described above. Thus, crystal of 4-(5-chloro-1,3,3-trimethyl-indolino)-methyl-7-(N-methyl-N-phenyl)amino-5'-chloro-1',3',3'-trimethyl-spiro[2H-1-benzopyran-2,2'-[2'H]-indole], having a pale pink-white color and a melting point of 162° through 163° C., is obtained. The yield is 52.3%.

Although these compounds are colorless under ordinary conditions, when the compounds are heated, for example, at a temperature of from 100° to 200° C. for approximately 30 seconds, the compounds are sublimated to develop a magenta color on an electron acceptor.

The typical properties of the compounds A, B, C, D and E are shown in a Table below. The Table indicates the color density and hue when each compound is sublimated to develop a color on electron acceptor paper. The coloring condition is as follows. A 1% solution of each compound in methylene chloride is impregnated into a baryta paper sheet and, then, after drying the paper sheet, a sheet of an electron acceptor paper, i.e. clay paper or resin paper, is placed over the baryta paper sheet and is heated at a temperature of 190° C. for 5 seconds.

TABLE

| Compound | Molecular weight | Melting point (°C.) | Appearance | Color Density Clay paper | Color Density Resin paper | Hue |
|---|---|---|---|---|---|---|
| A | 520.94 | 183–185 | Powder of pale pink-white | 0.80 | 1.09 | Red-Purple |
| B | 535.76 | 169–170 | Powder of pale pink-white | 1.44 | 1.38 | " |
| C | 583.52 | 174–175 | Powder of pale pink-white | 0.80 | 1.26 | " |
| D | 624.70 | 162–163 | Powder of pale pink-white | 0.34 | 0.96 | Purple |
| E | 590.60 | 183–184 | Powder of pale pink-white | 1.15 | 1.32 | " |

Phenazine dyes having the following formula [VII] have been heretofore known as a colorless sublimable dye capable of developing a magenta color.

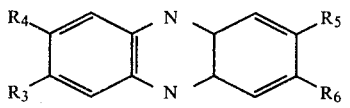

[VII]

(wherein $R_3$, $R_4$, $R_5$ and $R_6$ independently represent a lower alkyl group, an alkyl amino group or an amino group.)

Examples of such phenazine dyes are 2,8-bis-(dimethylamino)-phenazine, 2-amino-8-dimethylamino-phenazine, 2-amino-3-methyl-8-dimethylamino-phenazine and the like.

Indole dyes having the following formula [VIII] have also been known as a colorless sublimable dye capable of developing a magenta color.

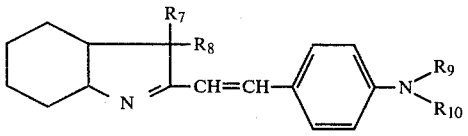

[VIII]

(wherein $R_7$ and $R_8$ independently represent a lower alkyl group and $R_9$ and $R_{10}$ independently represent a cyanoalkyl group, a haloalkyl group or a lower alkyl group.)

Examples of such indole dyes are 2-[4-(N-β-cyanoethyl-N-methyl)aminostyryl]-3,3-dimethyl-3H-indole, 2-[4-(N-β-chloroethyl-N-ethyl)aminostyryl]-3,3-dimethyl-3H-indole, 2-[4-(N,N-dimethyl)aminostyryl]-3,3-dimethyl-3H-indole and the like.

Fluoran dyes, such as 3-dialkylaminobenzofuran and the like, have also been known as colorless sublimable dyes capable of developing a magenta color.

However, the above-mentioned known dyes have an excitation purity of less than 0.5 and the clarity of the image formed from such dyes is practically insufficient. Contrary to this, the excitation purity of the present colorless sublimable dyes, which are capable of forming a magenta color image, that is, spirobenzopyrane indole compounds having the above-mentioned general formula [I], is about 0.5 through about 0.7, and; therefore, the clarity of the image derived therefrom is practically satisfactory.

The carrier which supports the colorless sublimable dye of the present invention must be one through which light can be transmitted. Examples of such carriers are transparent resin binders such as, for example, styrene resin, styrene-butadiene resin, acrylic acid ester resin, gelatine, polyvinyl alcohol resin, phenol resin, epoxy resin, melamine resin and the like; transparent resin beads such as, for example, those made from acrylic acid ester resin, styrene resin, epoxy resin, phenol resin, melamine resin and the like; and glass beads. These carriers can be advantageously dyed or colored by suitable coloring agents, such as organic or inorganic dyes and pigments, to thereby easily provide a color separation function which is necessary for the reproduction of a color image.

Since the colorless sublimable dyes of the present invention are substantially colorless even when they are supported or carried on the above-mentioned carriers, they do not adversely affect the optical properties of the previously dyed carriers. Therefore, the use of the colorless sublimable dye of the present invention exhibits its maximum advantage when the particle develops a complementary color with respect to the color of the dyed particle.

The present invention will be illustrated in detail with reference to the accompanying drawings showing the preferred embodiments. However, the present invention is not intended to be limited by these drawings.

Figure 1:
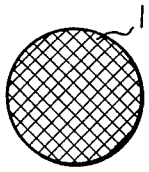
FIGS. 1 to 3 are schematic drawings showing the typical constructions of the preferred embodiments of the particles according to the present invention.

As shown in FIG. 1, a particle 1 according to one embodiment of the present invention is formed by particulately or molecularly dispersing a coloring agent and the colorless sublimable dye of the present invention in a transparent resin binder and, then, granulating the dispersion in the conventional manner.

Figure 2:
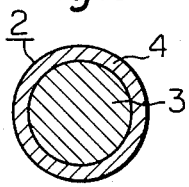

FIG. 2 shows a typical construction of a particle 2 according to another embodiment of the present invention. The particle 2 is composed of a layer 4 containing the colorless sublimable dye of the present invention coated over a light transmission bead 3 made from glass, acrylic acid ester resin, styrene resin and the like. The bead 3 may be dyed with a coloring agent. The layer 4 is formed by particulately or molecularly dispersing the colorless sublimable dye of the present invention in a transparent resin binder. The coating of this layer 4 onto the bead 3 can be conveniently performed in any conventional manner, such as a spray dry coating and a fluidized bed coating.

Figure 3:
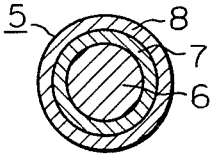

FIG. 3 shows a typical construction of a particle 5 according to a further embodiment of the present invention. The particle 5 comprises an innermost nucleus of a transparent bead 6 made from glass, acrylic acid ester resin, styrene resin and the like, an intermediate coloring agent layer 7 composed of the above-mentioned transparent resin binder and a coloring agent, and an outermost colorless sublimable dye layer 8 containing the above-mentioned transparent resin binder and the colorless sublimable dye of the present invention dispersed particulately or molecularly therein. The coating of the coloring agent layer 7 and the colorless sublimable dye layer 8 over the bead 6 can be performed in any order. That is, it is possible to first coat the colorless sublimable layer 8 over the entire surface of the bead 6 and then to coat the coloring agent layer 7 thereover. A preferable coloring agent can include, for example, acid dyes, basic dyes, direct dyes, metal complex dyes and the like.

For optimum results, it is preferred that the amount of the colorless sublimable dye present in 100 parts by weight of transparent binder be within the range of from about 0.3 to about 30 parts by weight, and the amount of the coloring agent present in 100 parts by weight of transparent binder be within the range of from about 0.1 to about 50 parts by weight. When the amount of the colorless sublimable dye is less than 0.3 parts by weight based on 100 parts by weight of the binder, enough reflective color density cannot be obtained. When the amount of the colorless sublimable dye is more than 30 parts by weight based on 100 parts by weight of the binder, excess color density is unpreferably shown. Similarly, when the amount of the coloring agent is less than the above-mentioned lower limit, enough color separation cannot be obtained. On the other hand, when the amount of the coloring agent is more than the above-mentioned upper limit, transparent beads cannot be obtained.

The above-mentioned light transmission particles 1, 2 and 5 should preferably be in the forms of spheres, and a suitable diameter of each particle should be within the range of from a few microns to about 80 microns. Although the thickness of each of the layers 4, 7 and 8 is not limited to any special values as long as the layers substantially cover the entire surface of the particle, the thickness should preferably be within the range of from about 0.1 to about 5 microns.

The principle of the image forming process in which the light transmission particles of the present invention are employed is as follows. The light transmission particles of the present invention are caused to adhere electrostatically onto a photosensitive plate containing a photosensitive material and at least a photoconductive substance dispersed therein, and, then, such particles are imagewise exposed to remove the electric charges from the particles on the radiated or irradiated portions of the photosensitive plate. The discharged particles are removed from the photosensitive plate by an appropriate but sufficient external force. Thus, an image composed of the remaining particles is formed on the photosensitive plate. By heating the particle image together with an electron acceptor, the colorless sublimable dye contained in the particles is sublimated and developed on the electron acceptor to form a color image. As mentioned above, since the colorless sublimable dye of the present invention is separately used with respect to the electron acceptor, an advantage is brought about because the characteristics of the photosensitive plate are not adversely affected. Any conventional photosensitive plate for electrophotography can be used. Such photosensitive plate can be, for example, zinc oxide photosensitive paper, metallized selenium plate, cadmium sulfide photosensitive plate, polyvinyl carbazole film and the like.

The electron acceptor can be, for example, activated clay, tartaric acid, bisphenol A, p-phenyl phenol resin and the like. The electron acceptor can be incorporated into the photosensitive plate or transfer paper. If the electron acceptor is present in a photosensitive plate, a developed color image of the colorless sublimable dye can be obtained on the photosensitive plate. On the other hand, if the electron acceptor is contained in a transfer paper, then a developed color image can be obtained on the transfer paper.

The light transmission particle of the present invention can be used not only for obtaining a monochromatic magenta image having a high clarity (or color definition) and a high reflection density but also for obtaining a mixed or full color image together with other colorless sublimable dyes, as will be illustrated in detail with reference to the accompanying drawings.

Figure 4:
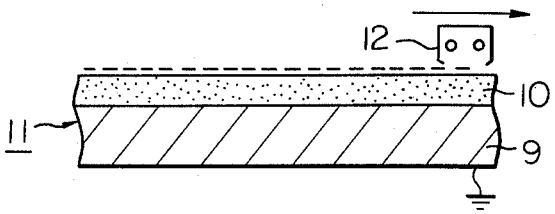
FIGS. 4 to 9 are schematic drawings showing the principle of the monochromatic or single-colored image forming process using the particles according to the present invention.
Figure 5:
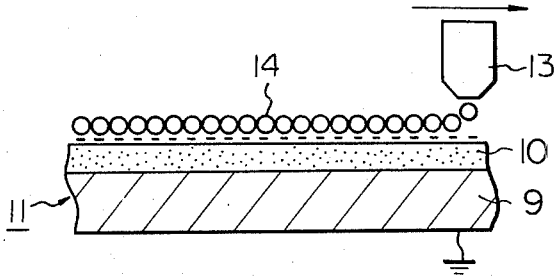
Figure 6:
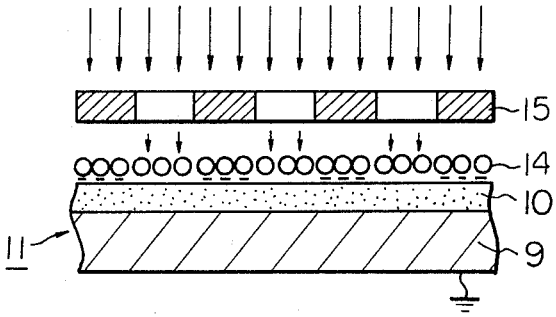
Figure 7:
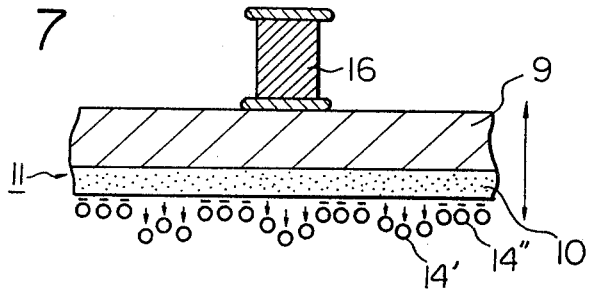
Figure 8:
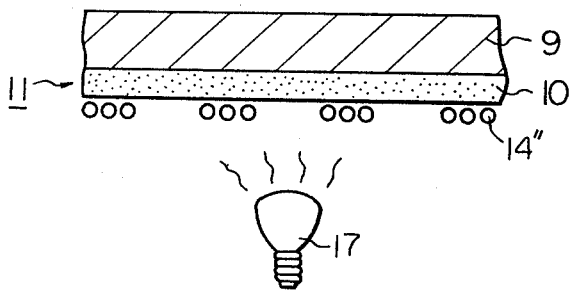
Figure 9:
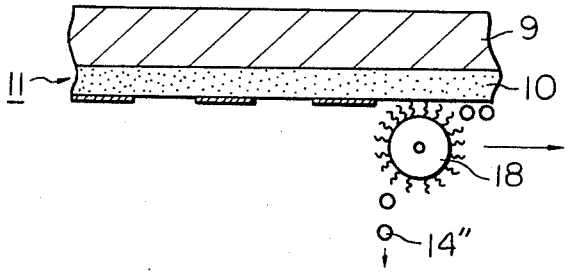

A method for obtaining a monochromatic or single-color image will be first illustrated with reference to FIGS. 4 to 9. In FIG. 4, a photoconductive support or a photosensitive plate 11 comprising a conductive base 9 and an electron acceptor 10 placed thereon is electrostatically charged at a dark plate by means of, for example, a corona charger 12 to generate a negative charge on the surface of the plate 11. If the conductive base is of a p-type semiconducting material, a positive charge is naturally generated. Light transmission particles 14 for forming a color image according to the present invention are then spread over the entire surface of the photosensitive plate 11 which is negatively charged by an appropriate particle dispenser 13 (please refer to FIG. 5). Thus, the particles 14 are caused to adhere electrostatically to the plate 11. The particles 14 are preferably placed in approximately one single layer. Then, as shown in FIG. 6, the particles 14 are imagewise exposed through an original 15 and the charge of the radiated portions of the particles 14 is removed or weakened by the light. The particles 14' having the weakened or removed electrostatic attracting force are taken out of the photosensitive plate 11 by vibrating the plate 11 with, for example, a magnetic vibrator 16 (see FIG. 7). Thus, the particles 14'' applied with an electrostatic force are left on the support 11 to thereby obtain a particle image. The particle image is then heated, as shown in FIG. 8, by means of, for example, an infrared lamp 17, whereby the colorless sublimable dye present in the particles 14'' is sublimed and reacted with an electron acceptor present in the photoconductive material 10 to develop a magenta color. The particles 14'' are then removed from the surface of the plate 11 by means of, for example, a cleaning brush to form a magenta image corresponding to the original 15.

The colorless sublimable dye to be employed in the above-mentioned image forming process must exhibit the following characteristics.

(1) The dye must be stable at an ambient temperature. That is, it cannot be sublimed or deteriorated by, for example, aerial oxidation during storage.

(2) The reflection density in the form of powder should be 0.15 or less.

(3) The dye must be sublimed by heating to develop a color on the electron acceptor. The heating must be carried out under such conditions that the photoconductive material and the electron acceptor are not thermally deteriorated within a relatively short time, for example, within 20 seconds at a temperature of about 200° C. Furthermore, the reflection density of the developed color must be 1.0 or more.

(4) The stability during storage, resistance to light and clarity (excitation purity), of the color-developed dye must be high.

(5) The dye must not develop a color during manufacture of light transmission particles and, further, must not adversely affect the optical properties of the particles.

The above-mentioned colorless sublimable dyes of the present invention, that is, spirobenzopyrane indole compounds having the general formula [I], satisfy all of the requirements stated above. As a result, an excitation purity between 0.5 and 0.7 of the colorless sublimable dyes of the present invention can be obtained.

The light transmission particle of the present invention can be also used, together with other types of colorless sublimable dyes, in a process for obtaining a mixed or full color image, especially by one exposure and one development.

In order to obtain a full color image, a subtractive color process employing, as image forming materials, magenta, cyan and yellow dye materials is utilized. Therefore, it is necessary to use three types of particles, that is,

- light transmission particles G which transmit a green light and develop a magenta color,
- light transmission particles R which transmit a red light and develop a cyan color, and
- light transmission particles B which transmit a blue-purple light and develop a yellow color.

The selective light transmission properties of the particles can be effected by dyeing the particles with a coloring agent. Suitable coloring agents include, for example, acid dyes, basic dyes, direct dyes, metal complex dyes, pigments and the like.

Typical coloring agents for transmitting a green light are, for example, C.I. Acid Green 9, 27, 40, 41 and 43; C.I. Basic Green 1 and 4; C.I. Pigment Green 2 and 7; and the like. Examples of a red light transmission coloring agent are C.I. Acid Red 6, 14, 18, 27, 42, 82, 83, 85, 87, 133 and 211; C.I. Basic Red 14, 27, 32 and 34; C.I. Pigment Red 2, 5, 6, 11, 12 and 27; and the like. Examples of a blue-purple light transmission coloring agent are C.I. Acid Blue 23, 40, 62, 83, 113, 120 and 183; C.I. Direct Blue 86; C.I. Basic Blue 7, 22, 26 and 65; C.I. Pigment Blue 2, 15 and 17; and the like.

The other dyes which are used together with the colorless sublimable dyes of the present invention for developing a magenta color must satisfy the following requirements:

- the sublimation rates thereof are substantially identical to each other;
- the coloring materials for each color are miscible with each other, and;
- the dyes can be developed with a common acidic substance.

Such colorless sublimable dyes for developing a yellow color are, for example, N-(1,2-dimethyl-3-yl)-methylidene-2, 4-dimethoxy aniline, N-(1-methyl-2-phenyl-indole-3-yl)methylidene-2, 4-dimethoxy aniline and the like.

The colorless sublimable dyes for developing a cyan color which satisfy the above-mentioned requirements, are for example, acyl leucophenoxazine compounds. Typical acyl leucophenoxazine compounds are, for example, 3,7-bis-diethylamino-10-trichloroacetyl-phenoxazine, 3,7-bis-diethylamino-10-isobutyryl-phenoxazine, 3,7-bis-diethylamino-10-acetyl-phenoxazine, 3,7-bis-diethylamino-10-crotonoyl-phenoxazine, 3,7-bis-diethylamino-10-benzoyl-phenoxazine, 3,7-bis-diethylamino-10-dichloroacetyl-phenoxazine, 3,7-bis-diethylamino-10-monochloroacetyl-phenoxazine and the like.

One embodiment of a process for forming a full color image in which three types of light transmission particles one of which is the light transmission particle of the present invention, are employed, will be illustrated with reference to FIGS. 10 to 13.

Figure 10:
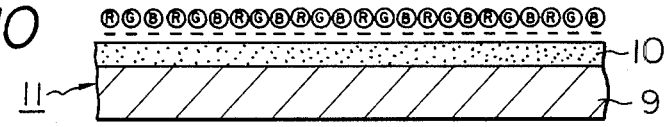
FIGS. 10 to 13 are schematic drawings showing the principle of the full-color image forming process using the particles according to the present invention.
Figure 11:
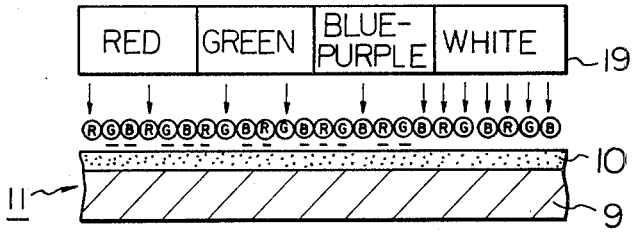
Figure 12:
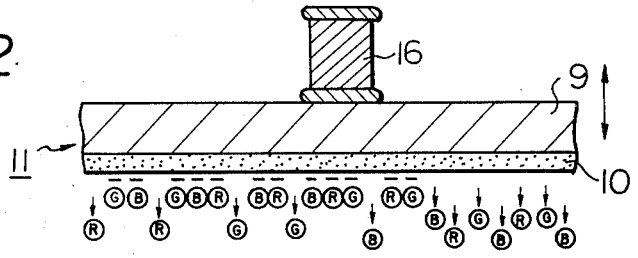

As shown in FIG. 10, the above-mentioned three types of light transmission particles R, G and B are spread randomly over the entire surface of a panchromatic photosensitive plate 11 which comprises a conductive base 9 and an electron acceptor 10 and which is negatively charged. The particles R, G and B are caused to strongly and electrostatically adhere to the surface of the photosensitive plate 11. The particles R, G and B are exposed through a color original 19 comprising red, green, blue-purple and white in a manner as shown in FIG. 11. Thus, the radiated portions of the photosensitive plate 11 are discharged thereby losing the electrostatic adhesion force. Accordingly, when the photosensitive plate 11 is vibrated by means of, for example, a magnetic vibrator 16, the particles contacting the discharged portions of the photosensitive plate 11 are removed from the plate 11 and only the particles contacting the charged portions of the photosensitive plate 11 are left on the plate 11 (see FIG. 12).

Figure 13:
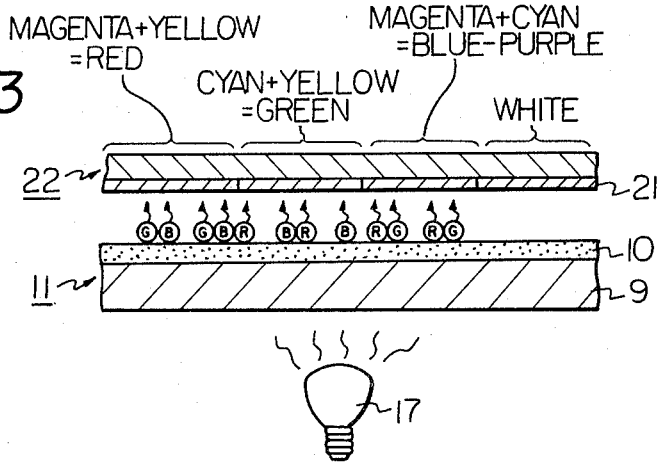

Thereafter, a sheet of transfer paper 22 having the above-mentioned electron acceptor layer 21 is placed over the photosensitive plate 11 as shown in FIG. 13 and heated, whereby the colorless sublimable dyes present in each remaining particle are sublimed and adsorbed into the electron acceptor to form each dye color. For example, in the portion exposed by a red light, where the particles G and B are left, the mixed color of magenta and yellow dye, that is, red color, is reproduced upon heating. The other portions exposed by green, blue-purple and white light reproduce the respective colors of the original 19 as shown in FIG. 13.

The image forming processes using the light transmission particles of the present invention will be further illustrated by the following Examples. However, the present invention is by no means limited by such Examples.

EXAMPLE 1

70 g of the above-mentioned compound A (i.e. a colorless sublimable dye for developing a magenta color) and 10 g of a styrene-butadiene copolymer resin were dissolved in 1 kg of monochlorobenzene. Into this solution 1 kg of glass beads was added and sufficiently mixed therewith. By using a rotary coater, the mixture was mixed, dried, and then coated upon the glass beads. Thus, colorless transparent particles were obtained.

Zinc oxide photosensitive paper sheets were electrostatically charged at a dark place. The colorless transparent particles prepared above were spread over the charged photosensitive sheets and excess particles were removed therefrom. Thus, the particles were placed on the entire surface of the photosensitive sheets in approximately one single layer.

The photosensitive sheets thus obtained were then imagewise exposed and, thereafter, the photosensitive sheets were vibrated in such a way that the particles adhering onto the surface of the photosensitive sheets were caused to face downwardly. The particles which were placed on the radiated portions of the photosensitive sheets fell from the photosensitive sheets, and the remaining particles together formed an image on the photosensitive sheet.

Bottom paper (resin paper) sheets for pressure-sensitive copying paper containing, as a main component, p-phenyl phenol, were placed over the particles remaining on the photosensitive sheets serving as transfer paper means, and were heated at a temperature of 200° C. for 7 seconds. When the bottom sheets were pulled off, a clear magenta image corresponding to the original was obtained on each transfer paper means. The color density of the image portions was 1.4, and the density of the non-image portions was substantially zero (i.e., little fogging was observed).

EXAMPLE 2

300 g of melamine and 30 g of C.I. Acid Green 27 (i.e. a green light transmission coloring agent) were dissolved in 700 g of water. The resultant solution was heated and dried by using a spray dryer to produce green particles. Into 100 g of the green particles thus obtained, 5 g of the above-mentioned compound B (i.e. a colorless sublimable dye), 0.5 g of poly(vinyl acetate)resin, 20 g of toluene and 80 g of trichloroethylene were added and mixed together. The resultant mixture was spray-dried by using a spray dryer to produce green particles coated with the colorless sublimable dye over the entire surface thereof. The green color of the coated particles was substantially the same as that of the uncoated particles.

Zinc oxide photosensitive paper sheets were electrostatically charged at a dark place. The green particles prepared above were spread over the charged photosensitive sheets and excess particles were removed therefrom. Thus, the particles were placed on the entire surface of the photosensitive sheets in approximately one single layer.

The photosensitive sheets thus prepared were then imagewise exposed through a color original and, then, the exposed photosensitive sheets were vibrated in such a way that the particles adhering onto the surface of the photosensitive sheets were caused to face downwardly. The particles which were located on the radiated portions of the photosensitive sheets fell from the photosensitive sheets and the remaining particles formed a separated or divided green image on the photosensitive sheets. That is to say, in portions of the photosensitive sheets corresponding to the portions of the original which did not contain a green color, the particles still adhered to the photosensitive sheets, whereas in the portions of the photosensitive sheets corresponding to the portions of the original which contained a green color, the particles were removed from the photosensitive sheets.

Bottom paper (clay paper) sheets for pressure-sensitive copying paper containing, as a main component, activated clay were placed over the remaining particles on the photosensitive sheets serving as transfer papers, and heated at a temperature of 200° C. for 5 seconds. When the transfer paper was pulled off, a clear magenta image was obtained at the portions where the particles adhered thereto. The color density of the image portions was 1.45, and the density of the non-image portions was substantially zero (i.e. little fogging was observed).

EXAMPLE 3

A liquid composition A was prepared by adding 20 g of C.I. Acid Red 265, C.I. No. 18129 (Mitsui Acid Brilliant Milling Red BL manufactured by Mitsuitoatsu Chemical Co., Ltd.) (i.e. a red light transmission coloring agent) and 15 g of 3,7-bis-diethylamino-10-trichloroacetyl-phenoxazine (i.e. a colorless sublimable dye providing a cyan image) to 2 kg of a 5% aqueous polyvinyl alcohol solution, and then by sufficiently mixing all of the components together.

A liquid composition B was prepared by adding 35 g of C.I. Acid Green 41, C.I. No. 62560 (Suminol Milling Cyanin Green 6G manufactured by Sumitomo Chemical Ind., Ltd.) (i.e. a green light transmission coloring agent) and 13 g of the above-mentioned compound C (i.e. a colorless sublimable dye providing a magenta image) to 2 kg of a 5% aqueous polyvinyl alcohol solution, and then, sufficiently mixing all of the components together.

A liquid composition C was prepared by adding 30 g of C.I. Basic Blue 26, C.I. No. 44045 (Aizen Victoria Blue BH manufactured by Hodogaya Chemical Co., Ltd.) (i.e. a blue light transmission coloring agent) and 20 g of N-(1,2-dimethyl-3-yl)methylidene-2,4-dimethoxyaniline (i.e., a colorless sublimable dye providing a yellow image) to 2 kg of a 5% aqueous polyvinyl alcohol solution, and then by sufficiently mixing all of the components together.

The liquid compositions A, B and C, prepared as described above, were separately granulated by spray drying and particles of each composition having diameters of 37 to 44 microns were obtained after being subjected to a size screening process. 5 g of each group of particles were taken out and mixed together to prepare a mixture of particles for forming a color image.

On the other hand, a tartaric acid in acetone solution was coated, as a thin film, onto a zinc oxide photosensitive plate which was previously subjected to a conventional panchromatic treatment, and, thereafter, the coated plate was kept at a dark place.

The photosensitive plate thus obtained was then subjected to a conventional corona charge treatment at a dark place. When the mixture of particles, prepared as described above, was spread over the entire surface of the charged photosensitive plate, the particles for forming a color image were caused to electrostatically adhere to the charged surface of the photosensitive plate.

The photosensitive plate was imagewise exposed through a color original, followed by being subjected to a conventional developing process. The developed plate was then heated by means of an infrared lamp; thereafter, the particles located on the plate were removed by a cleaning brush. Thus, a color image substantially identical to the original was reproduced on the plate. For instance, a red image was formed in the portions of the photosensitive plate corresponding to the red portions of the original by a mixture of magenta and yellow images which were obtained from a sublimable dye for providing a magenta image and a sublimable dye, for providing a yellow image, respectively. As the heating temperature was increased, the amount of the sublimated colorless sublimable dye was increased so that a color image was spread over the photosensitive plate. When the heating was carried out at a temperature of 190° C. for 20 seconds, a clear color print having a moderate image spread and having a sufficient color mixture was obtained.

What we claim is:

1. A light transmission particle for forming a color image comprising (a) 100 parts by weight of a transparent resin binder, (b) about 0.3 to about 30 parts by weight of at least one spirobenzopyrane indole compound having a general formula I:

I

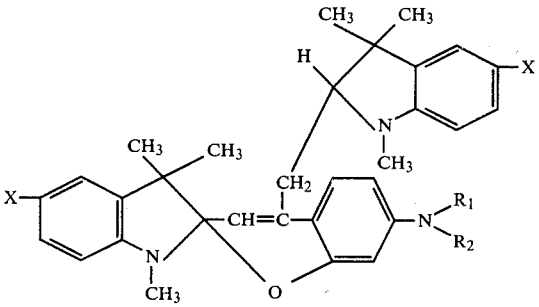

wherein $R_1$ and $R_2$ independently represent a methyl, ethyl, or phenyl group and X represents hydrogen, a methyl group or a halogen atom, and (c) about 0.1 to about 50 parts by weight of at least one coloring agent.

2. A light transmission particle for forming a color image as claimed in claim 1, wherein said spirobenzopyrane indole compound is selected from the group consisting of 4-(1,3,3-trimethyl-indolino)methyl-7-(N,N-diethyl)amino-1',3',3'-trimethyl-spiro[2H-1-benzopyrane-2,2'-[2'H]-indole], 4-(1,3,3-trimethyl-indolino)-methyl-7-(N-methyl-N-phenyl)amino-1',3',3'-trimethyl-spiro[2H-1-benzopyrane-2,2'-[2'H]-indole], 4-(1,3,3,5-tetramethyl-indolino)methyl-7-(N-methyl-N-phenyl-)amino-1',3',3',5'-tetramethyl-spiro[2H-1-benzopyrane-2,2'-[2'H]-indole], 4-(5-chloro-1,3,3-trimethyl-indolino)-methyl-7-(N-methyl-N-phenyl)amino-5'-chloro-1',3',3'-trimethyl-spiro[2H-1-benzopyrane-2,2'-[2'H]-indole] and 4-(5-chloro-1,3,3-trimethyl-indolino)methyl-7-(N,N-diethyl)amino-5'-chloro-1',3',3'-trimethyl-spiro[2H-1-benzopyrane-2,2'-[2'H]-indole].

3. A light transmission particle as claimed in claim 1, wherein said transparent resin binder is selected from the group consisting of styrene resin, styrene-butadiene resin, acrylic acid ester resin, gelatine, polyvinyl alcohol resin, phenol resin, epoxy resin and melamine resin.

4. A light transmission particle as claimed in claim 1, wherein said spirobenzopyrane indole compound is selected from the group consisting of 4-(1,3,3-trimethyl-indolino)methyl-7-(N,N-diethyl)amino-1',3',3'-trimethyl-spiro[2H-1-benzopyrane-2,2'-[2'H]-indole], 4-(1,3,3-trimethyl-indolino)methyl-7-(N-methyl-N-phenyl-)amino-1',3',3'-trimethyl-spiro[2H-1-benzopyrane-2,2'-[2'H]-indole], 4-(1,3,3,5-tetramethyl-indolino)methyl-7-(N-methyl-N-phenyl)amino-1',3',3',5'-tetramethyl-spiro[2H-1-benzopyrane-2,2'-[2'H]-indole, 4-(5-chloro-1,3,3-trimethyl-indolino)methyl-7-(N-methyl-N-phenyl)amino-5'-chloro-1',3',3'-trimethyl-spiro[2H-1-benzopyrane-2,2'-[2'H]-indole] and 4-(5-chloro-1,3,3-trimethyl-indolino)-methyl-7-(N,N-diethyl)amino-5'-chloro-1',3',3'-trimethyl-spiro[2H-1-benzopyrane-2,2'-[2'H]-indole].

5. A light transmission particle as claimed in claim 1, wherein said coloring agent is selected from the group consisting of acid dyes, basic dyes, direct dyes, metal complex dyes and pigments.

6. A light transmission particle for forming a color image as claimed in claim 1, wherein said particle comprises (a) a transparent bead and (b) a colorless sublimable dye layer coated on the surface of said bead, said colorless sublimable dye layer comprising 100 parts by weight of a transparent binder and 0.3 to 30 parts by weight of at least spirobenzopyrane indole compound having the above-mentioned general formula [I].

7. A light transmission particle as claimed in claim 6, wherein said spirobenzopyrane indole compound is selected from the group consisting of 4-(1,3,3-trimethyl-indolino)methyl-7-(N,N-diethyl)amino-1',3',3'-trimethyl-spiro[2H-1-benzopyrane-2,2'-[2'H]-indole], 4-(1,3,3-trimethyl-indolino)methyl-7-(N-methyl-N-phenyl-)amino-1',3',3'-trimethyl-spiro[2H-1-benzopyrane-2,2'-[2'H]-indole], 4-(1,3,3,5-tetramethyl-indolino)methyl-7-(N-methyl-N-phenyl)amino-1',3',3',5'-tetramethyl-spiro[2H-1-benzopyrane-2,2'-[2'H]-indole], 4-(5-chloro-1,3,3-trimethyl-indolino)methyl-7-(N-methyl-N-phenyl)amino-5'-chloro-1',3',3'-trimethyl-spiro[2H-1-benzopyrane-2,2'-[2'H]-indole] and 4-(5-chloro-1,3,3-trimethyl-indolino)methyl-7-(N,N-diethyl)amino-5'-chloro-1',3',3'-trimethyl-spiro[2H-1-benzopyrane-2,2'-[2'H]-indole].

8. A light transmission particle as claimed in claim 7, wherein said bead is selected from the group consisting of a glass bead, an acrylic ester resin bead, a styrene resin bead, a phenol resin bead, an epoxy resin bead and a melamine resin bead.

9. A light transmission particle as claimed in claim 8, wherein said bead is dyed with at least one coloring agent selected from the group consisting of acid dyes, basic dyes, direct dyes, metal complex dyes and pigments.

10. A light transmission particle for forming a color image as claimed in claim 1, wherein said particle comprises (a) a transparent bead, (b) a coloring agent layer coated on the surface of said bead, said layer comprising 100 parts by weight of a transparent binder and 0.1 to 50 parts by weight of at least one coloring agent selected from the group consisting of acid dyes, basic dyes, direct dyes, metal complex dyes and pigments and (c) a colorless sublimable dye layer coated over said coloring agent layer, said colorless sublimable dye layer comprising 100 parts by weight of a transparent binder and 0.3 to 30 parts by weight of at least one spirobenzopyrane indole compound having the above-mentioned general formula [I].

11. A light transmission particle as claimed in claim 10, wherein said spirobenzopyrane indole compound is selected from the group consisting of 4-(1,3,3-trimethyl-indolino)methyl-7-(N,N-diethyl)amino-1',3',3'-trimethyl-spiro[2H-1-benzopyrane-2,2'-[2'H]-indole], 4-(1,3,3-trimethyl-indolino)methyl-7-(N-methyl-N-phenyl-)amino-1',3',3'-trimethyl-spiro[2H-1-benzopyrane-2,2'-[2'H]-indole], 4-(1,3,3,5-tetramethyl-indolino)methyl-7-(N-methyl-N-phenyl)amino-1',3',3',5'-tetramethyl-spiro[2H-1-benzopyrane-2,2'-[2'H]-indole], 4-(5-chloro-1,3,3-trimethyl-indolino)methyl-7-(N-methyl-N-phenyl)amino-5'-chloro-1',3',3'-trimethyl-spiro[2H-1-benzopyrane-2,2'-[2'H]-indole] and 4-(5-chloro-1,3,3-trimethyl-indolino)-methyl-7-(N,N-diethyl)amino-5'-chloro-1',3',3'-trimethyl-spiro[2H-1-benzopyrane-2,2'-[2'H]-indole].

12. The light transmission particle as claimed in claim 11, wherein said bead is selected from the group consisting of a glass bead, an acrylic ester resin bead, a styrene resin bead, a phenol resin bead, an epoxy resin bead and a melamine resin bead.

13. A light transmission particle as claimed in claim 12, wherein said bead is first coated with said colorless sublimable dye layer and, then, coated thereover with said coloring agent layer.

* * * * *